US008714435B2

(12) United States Patent
Weissbrod

(10) Patent No.: US 8,714,435 B2
(45) Date of Patent: May 6, 2014

(54) COLLAPSIBLE CARTON

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 196 days.

(21) Appl. No.: 13/218,541

(22) Filed: Aug. 26, 2011

(65) Prior Publication Data

US 2011/0309134 A1 Dec. 22, 2011

Related U.S. Application Data

(63) Continuation-in-part of application No. 12/112,433, filed on Apr. 30, 2008, now Pat. No. 8,087,568.

(51) Int. Cl.
*B65D 5/00* (2006.01)
*B65B 43/00* (2006.01)

(52) U.S. Cl.
USPC ..... 229/101.2; 229/101

(58) Field of Classification Search
USPC ..... 229/101.2, 101, 117.01
See application file for complete search history.

(56) References Cited

U.S. PATENT DOCUMENTS 1,125,535 A * 1/1915 Hoffman ..... 229/101
2,791,367 A 5/1957 Mefford
3,280,871 A 10/1966 Taylor
3,291,373 A 12/1966 Joyce
3,313,467 A 4/1967 Anderskow
3,338,407 A 8/1967 Carlson
3,411,691 A * 11/1968 Whitaker et al. ..... 229/117.01
3,672,558 A * 6/1972 Johnson ..... 229/101
5,975,411 A 11/1999 Windolph, III
6,119,929 A 9/2000 Rose
6,138,901 A 10/2000 Kim et al.
6,394,336 B1 5/2002 Beneroff
6,669,045 B2 * 12/2003 Wang ..... 220/9.2
2009/0272790 A1 11/2009 Weissbrod

FOREIGN PATENT DOCUMENTS

WO 98/24711 6/1998

OTHER PUBLICATIONS

International Application No. PCT/IB2012/001643 International Search Report/Written Opinion, Nov. 2, 2012, 8 pages.
Office Action from U.S. Appl. No. 12/112,433—Sep. 15, 2011—56 pages.

(Continued)

*Primary Examiner* — Gary Elkins
*Assistant Examiner* — Christopher Demeree
(74) *Attorney, Agent, or Firm* — Hahn Loeser & Parks LLP

(57) ABSTRACT

An end-loaded collapsible carton is provided and includes a first pair of side walls extending substantially perpendicularly from a second pair of side walls. The first and second pair of side walls form a first end opening and a second end opening opposite the first end opening. The carton further includes a first carton closure extending from the first and second carton walls for covering the first end opening, and a second carton closure extending at an opposite end of the first and second carton walls for covering the second end opening. The first carton closure is formed from a first plurality of lid panels, and the second carton closure is formed from a second plurality of lid panels. The carton further includes scores for creating pleats fashioned in the carton side walls and lid panels for collapsing the side walls and lid panels in a uniform manner.

10 Claims, 14 Drawing Sheets

(56) References Cited

OTHER PUBLICATIONS

Office Action from U.S. Appl. No. 12/112,433—Nov. 24, 2010—32 pages.

Office Action from U.S. Appl. No. 12/112,433—Aug. 30, 2010—23 pages.

Office Action from U.S. Appl. No. 12/112,433—Apr. 29, 2010—18 pages.

* cited by examiner

COLLAPSIBLE CARTON

This U.S. patent application is a continuation-in-part (CIP) of and claims the benefit of and priority to U.S. patent application Ser. No. 12/112,433 filed on Apr. 30, 2008 which is incorporated herein by reference in its entirety.

TECHNICAL FIELD

The present invention pertains to packaging systems, and more particularly, to cartons having walls that in a uniform manner automatically collapse to a reduced size.

BACKGROUND OF THE INVENTION

Countless products are packaged and shipped to end-users in this country and around the world daily. Many products are placed in crates or boxes filled with packing material to minimize or prevent damage during shipping. Some products are stored and packaged in cartons, which may be sealed to prevent the enclosed items from exposure to ambient conditions. Other products are less sensitive and don't require a hermetic seal. Examples of packaged products may range from edible substances to industrial consumables, like welding electrodes. Cartons are commonly constructed from renewable or recycled material like, for example, corrugated cardboard, which is easy and relatively inexpensive to produce.

In many cases, similarly sized cartons are used to package different quantities of products. Some cartons may therefore contain a particular quantity of material leaving free space within the carton for the products to jostle about during shipment resulting in damage. This also affords the opportunity for stacked cartons to compress or deform. As the contents may not be uniformly distributed, pressure frequently collapses one end of the adjacent carton creating an uneven stacking surface. Cartons higher in the stack are therefore prone to falling and hence damage. Falling cartons also lead to an unsafe working environment. Furthermore, the tilted packaged contents look disorderly and unsightly.

It would be useful to provide a carton that automatically collapses under pressure in a uniform manner. Such a container would limit spacing within the container and maintain a level relationship between upper and lower surfaces of adjacent cartons.

BRIEF SUMMARY

In one embodiment, a collapsible carton is described and which comprises a first pair of vertical carton walls spaced apart by a second pair of carton walls. The second pair of carton walls extend substantially perpendicularly from the first pair of carton walls, thereby defining a first maximum carton volume between the first and second pair of carton walls. Additionally, the carton is fashioned to automatically collapse under pressure in a substantially uniform manner via at least one score-line, thus defining a second smaller carton volume when collapsed. Further, the first and second pair of carton walls form at least one side opening. The carton also includes at least one carton closure formed from a pair of major flaps and a pair of minor flaps extending from and at least partially along the width of the carton. The carton closure is substantially perpendicular to the carton walls in its closed position, and substantially covering the at least one side opening. At least one flap of the carton flaps includes a plurality of scores for collapsing the same in a uniform manner.

In another embodiment, the carton comprises a plurality of carton walls defining a first maximum carton volume. Additionally, the carton is fashioned to automatically collapse via at least a first score under pressure in a substantially uniform manner defining a second smaller carton volume. The plurality of carton walls form at least one end opening, and at least two of the plurality of carton walls each include a non-pleated section having no scores, and a pleated section that includes a plurality of scores that are each substantially parallel with respect to each other. Additionally, the carton includes at least one carton closure formed from a plurality of panels extending from and along at least a portion of the width of each of the carton walls. The plurality of panels are substantially perpendicular to the plurality of carton walls in when the carton closure is in a closed position for substantially covering at least one end opening. The carton closure further includes at least one panel having a plurality of scores.

In yet another embodiment, a collapsible carton includes a first pair of opposed side walls extending substantially perpendicularly from a second pair of opposed side walls. The first and second pair of side walls form a first end opening and a second end opening opposite the first end opening. The carton further includes a first carton closure extending from the first and second carton walls and which at least partially covers the first end opening, and a second carton closure extending at an opposite end of the first and second carton walls and which at least partially covers the second end opening. The first carton closure is formed from a first plurality of lid panels, and the second carton closure is formed from a second plurality of lid panels. The carton further includes a means for collapsing the first pair of side walls, and a means for collapsing the first carton closure and the second carton closure in a substantially uniform manner with respect to the collapsed first pair of side walls. The carton additionally includes a means for removably securing the first and second carton closure to the carton.

DETAILED DESCRIPTION OF THE INVENTION

Figure 1:
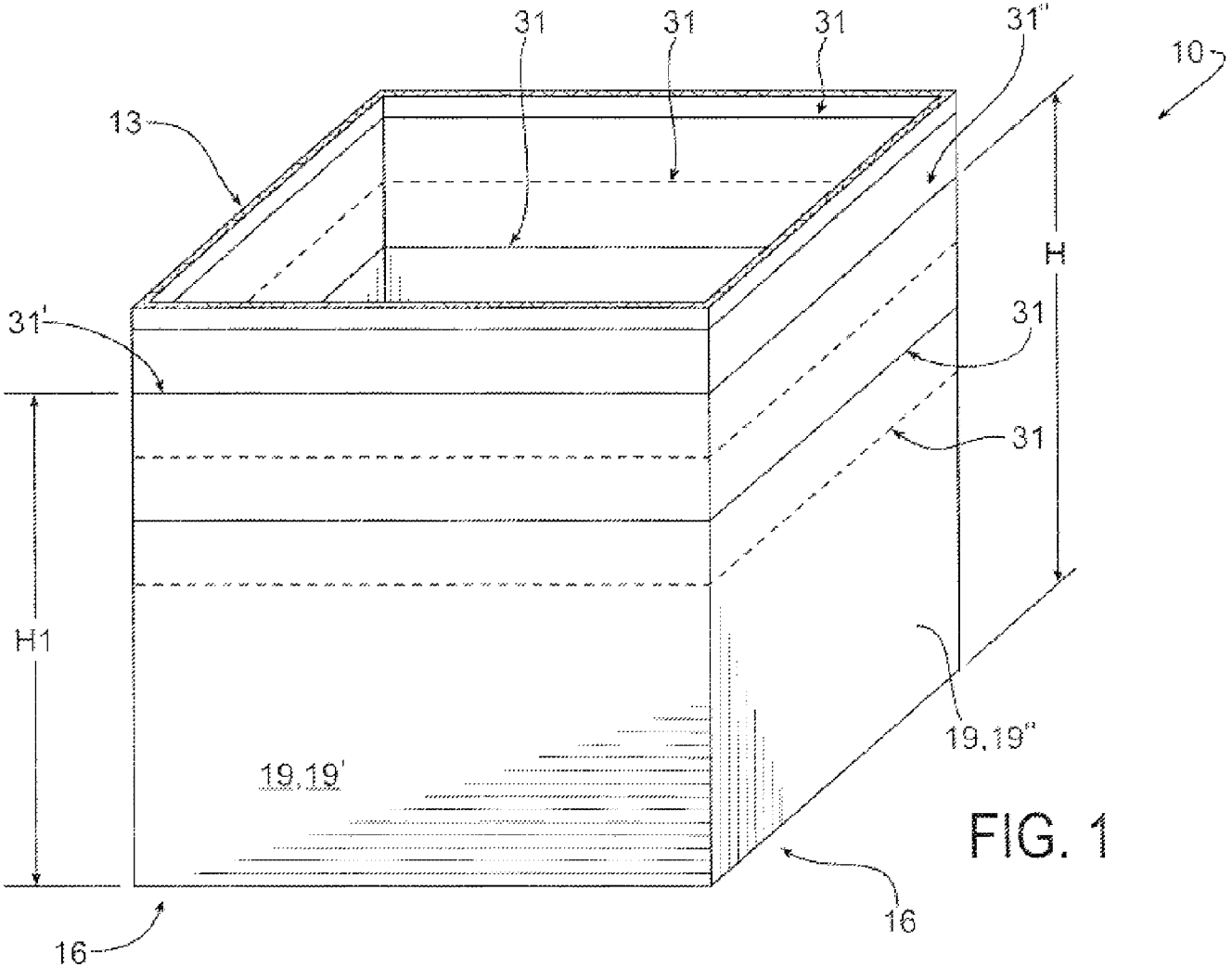
FIG. 1 is a perspective view of a top loadable carton having pleats with top flaps removed.

Referring now to the drawings wherein the showings are for purposes of illustrating embodiments of the invention only and not for purposes of limiting the same, FIG. 1 shows a carton depicted generally at 10. Carton 10 may be configured for storing a single or plurality of manufactured articles 13 (FIG. 3) for shipment to an end-user. As used herein, plurality is defined as two or more, with the upper limit (i.e., more) being within an amount chosen with sound engineering judgment. Examples of such articles 13 may include industrial consumables, like welding electrodes. The conglomerate weight of articles 13 may be relatively heavy with respect to its packaging. As such, carton 10 may be constructed from material having sufficient rigidity for storing such articles 13, but cost effective to use. Cardboard is just one type of material that may be utilized to construct carton 10. Other types of materials may include polymer substances or other fibrous material. Still any type of material may be used as is appropriate for use with the requirements described herein.

Figure 5:
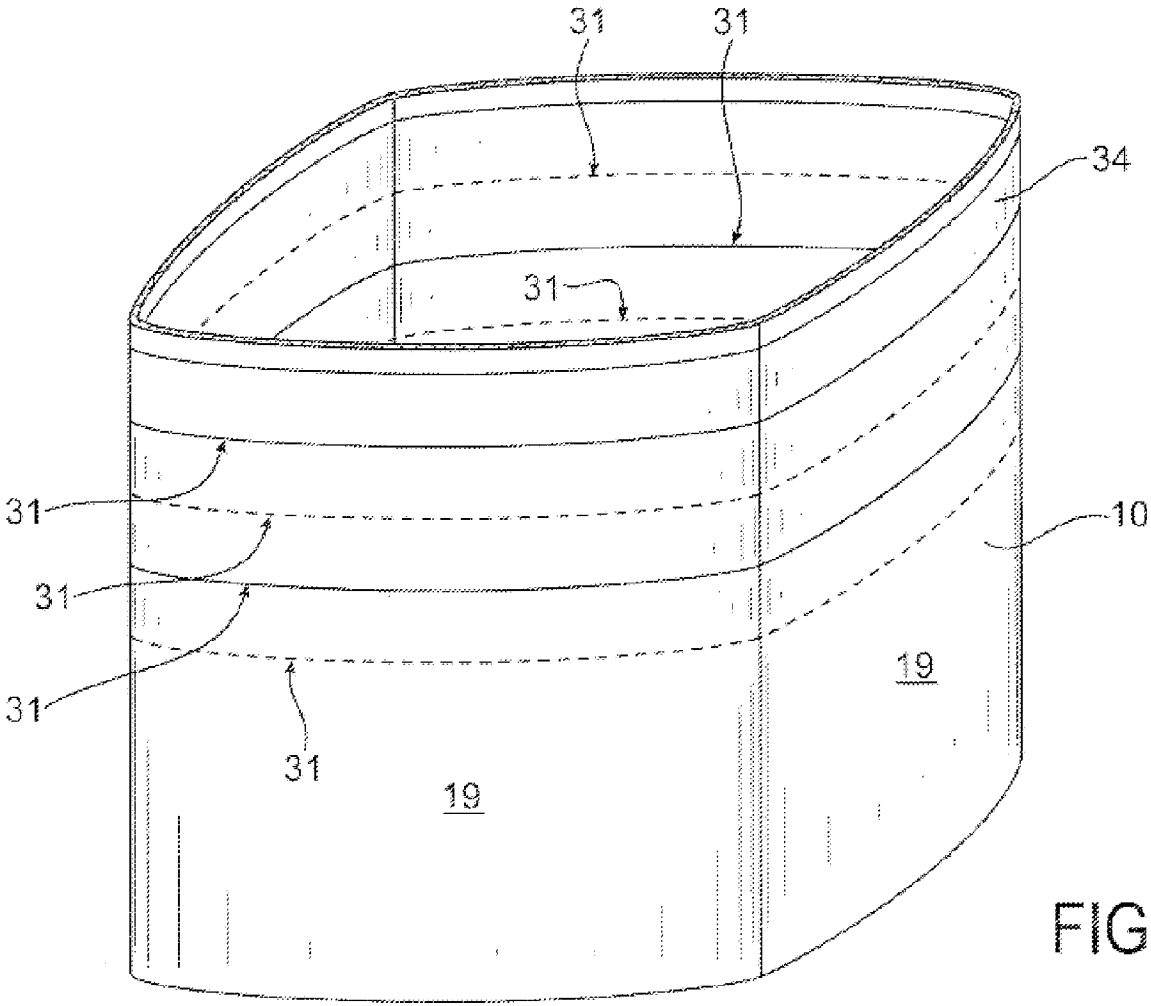
FIG. 5 is a perspective view of a carton drum having pleats with top flaps removed.

With reference to FIG. 1 and FIG. 5, carton 10 may be used to package varying quantities of articles 13. Carton 10 includes bottom panel 16 or base, also referred to herein as the carton bottom. Bottom panel 16 may be fabricated as a single contiguously formed sheet of material. However, other configurations are contemplated that include multiple panel sections assembled together to form bottom panel 16. Carton 10 further includes side walls 19 extending from bottom panel 16. In one embodiment, carton 10 may be generally polygonal in configuration. More specifically, as shown in FIG. 1, for example, carton 10 is boxlike; that is to say rectangular. The width and height of side walls 19 define a first maximum volume of carton 10. In one embodiment, side walls 19 of carton 10 may uniformly compress to a second smaller volume, as will be discussed further below. Additionally, side walls 19 may be integrally fashioned with bottom panel 16. Creases in the material may characterize the folding joint between bottom panel 16 and side walls 19. It is noted here that the embodiments described herein are not limited to planar side walls 19. Curved side walls 19 are also contemplated, which of course may be arranged to form a drum. Carton 10 may further include lid 22. Lid 22 may be comprised of multiple lid panels 23 extending respectively from one of side walls 19. As such, lid panels 23 may be integrally fashioned with respect to side walls 19. When filled with product, i.e. articles 13, lid panels 23 may be folded over and affixed together or fastened in place. It is noted here that FIG. 1 shows carton 10 without lid panels 23 for illustrative clarity only. However, it will be understood that in the current embodiment, lid 22 includes four lid panels 23, comprising two minor lid panels and two major lid panels, extending from respective sides of carton 10.

Figure 2:
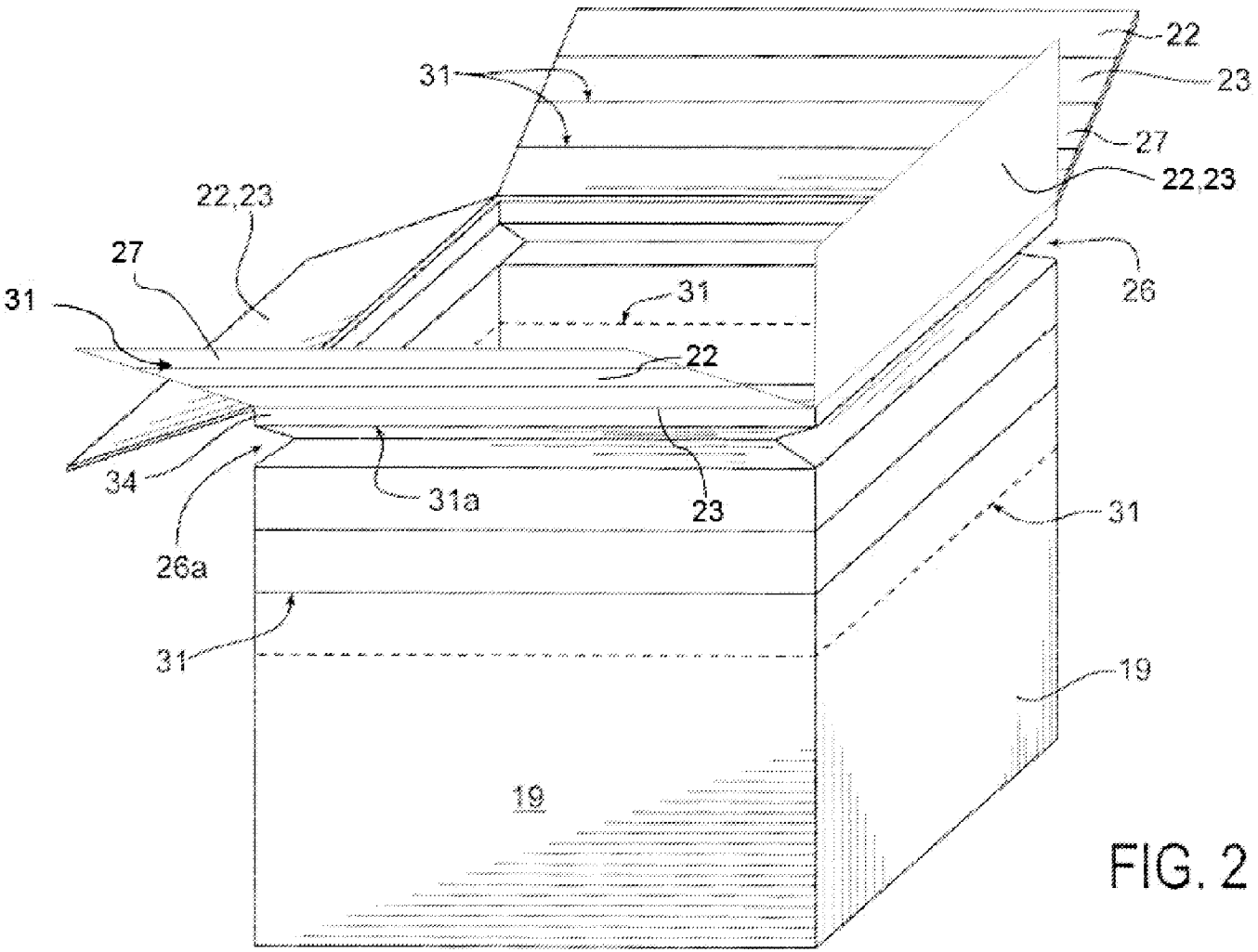
FIG. 2 is a perspective view of a carton having pleats with top flaps in an open position.

With continued reference to FIG. 1 and now also to FIG. 2, carton 10 includes a series of pleats 26 fashioned in various sections of carton 10. In one embodiment, side walls 19 may be fashioned with pleats 26 that cause side walls 19 to fold in upon itself thereby reducing the volume of carton 10. Pleats 26 may be created by scoring the surfaces of carton 10, and in particular side walls 19. By scoring it is meant that the material making up side walls 19 is cut or etched to slightly weaken the material at that location. It follows that scored carton 10 is therefore prone to bending or folding in a precise manner and controlled direction. Scoring may extend intermittently or continuously along one or more dimensions of side walls 19. Additionally, the amount of the scoring, i.e. depth or width, may vary depending on the configuration and material constructing carton 10. Of course, any manner of scoring the carton material known to persons having ordinary skill in the art may be chosen. Other portions of carton 10 may also be scored including but not limited to lid panels 23 to be discussed in detail below.

Figure 3:
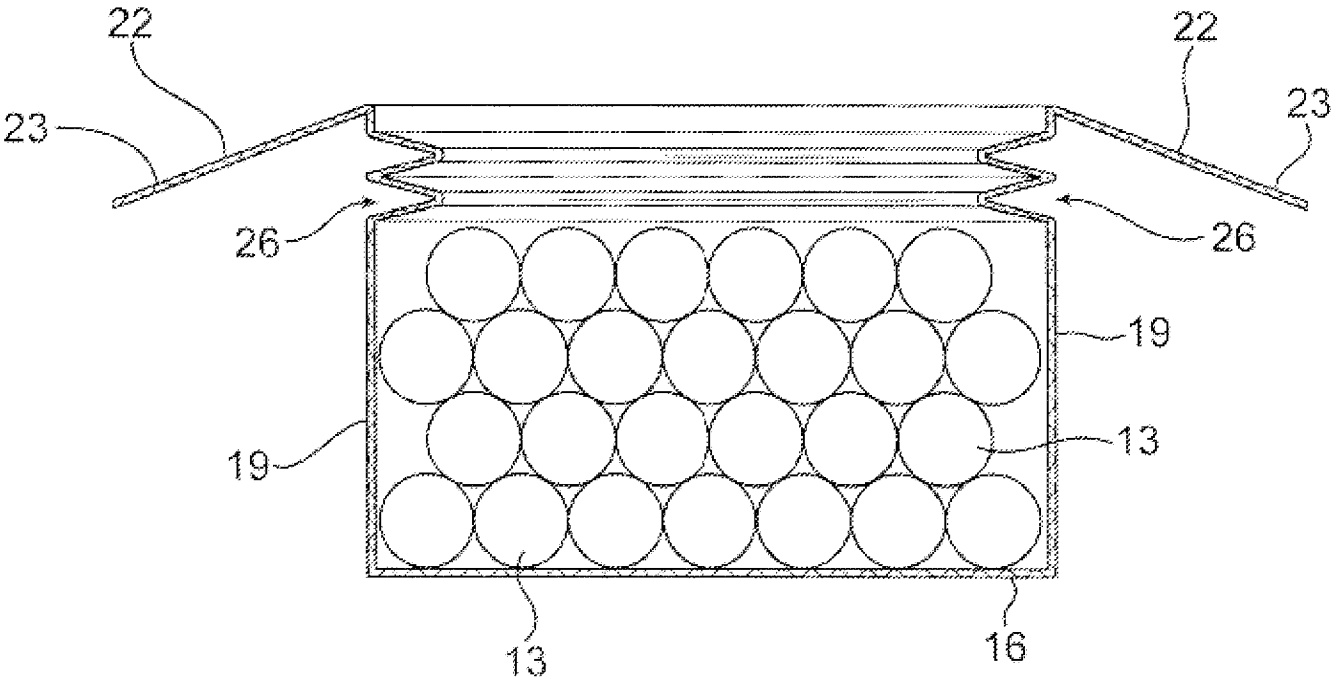
FIG. 3 is a cutaway side view of a carton having collapsed pleats.

With reference to FIG. 1 through FIG. 3, scores 31 in the carton material may be fashioned at various positions on side walls 19 and lid 22. In one embodiment, scores 31 are fashioned horizontally around the circumference of side walls 19. In other words, each individual side wall 19 includes its own score 31, parallel to the carton bottom, for creating pleats as mentioned above. Multiple scores 31 may be generally parallel to each other and bottom panel 16 and fashioned consecutively down side walls 19. However, angled and/or skewed scores 31 may be implemented without departing from the intended scope of coverage of the embodiments described herein. Scores 31 may also be fashioned in an alternating manner on both interior and exterior sides of side walls 19. That is to say that one score 31 may be formed on the inside of side wall 19, while the next is formed on the outside. In this manner, pleats 26 will compress cleanly in a predefined manner. It will be understood by persons of ordinary skill in the art that scoring material on a particular side causes the material to bend in that direction. Additionally, for each adjacent side wall 19, it is contemplated that scores 31 may be respectively offset vertically up or down so as not to overlap pleats 26. In this way, pleat 26 of one side wall 19 will be offset and not interfere with pleat 26 from an adjacent side wall 19. As such, height H is defined as the distance from bottom panel 16 to score 31' of first side wall 19'. And height H1 is defined as the distance from bottom panel 16 to score 31" of second adjacent side wall 19", where in one embodiment H1 is less than H. Alternatively, H1 may be substantially equal to H. Still any height or location of forming the scores on side walls 19 known to persons of ordinary skill in the art may be chosen.

In one embodiment, pleats 26, and more specifically scores 31, in side walls 19 are positioned spaced down from the top of side walls 19 by a predetermined amount leaving un-scored ledge 34 at the top of carton 10. Additionally, the distance from the top of carton 10 to first score 31*a* may range between substantially zero (0) to approximately 1 inch. However, other thicknesses of ledge 34 may be incorporated without departing from the intended scope of coverage of the embodiments described herein. The first score 31*a* may fashioned on the exterior of carton 10. Subsequently, the next score 31 may be fashioned alternatively on the inside. As depicted in FIG. 3, this causes first pleat 26*a* to fold in to the interior of carton 10. It will be realized that folding pleats 26 into carton 10 maintains the outer circumference of carton 10 as opposed to expanding it, which may be undesirable when stacking cartons 10. The remaining scores 31 may follow in a similar pattern. In one embodiment, enough scores 31 are fashioned to create two (2) pleats 26. However, any number of pleats 26 may be constructed in carton 10 with sound judgment. Additionally, scores 31 may be incorporated into lid panels 23. More specifically, scores 31 may be fashioned in minor panels 27 of lid 22, which inhibits lid panels 23 from breaking open during shipment.

Figure 4:
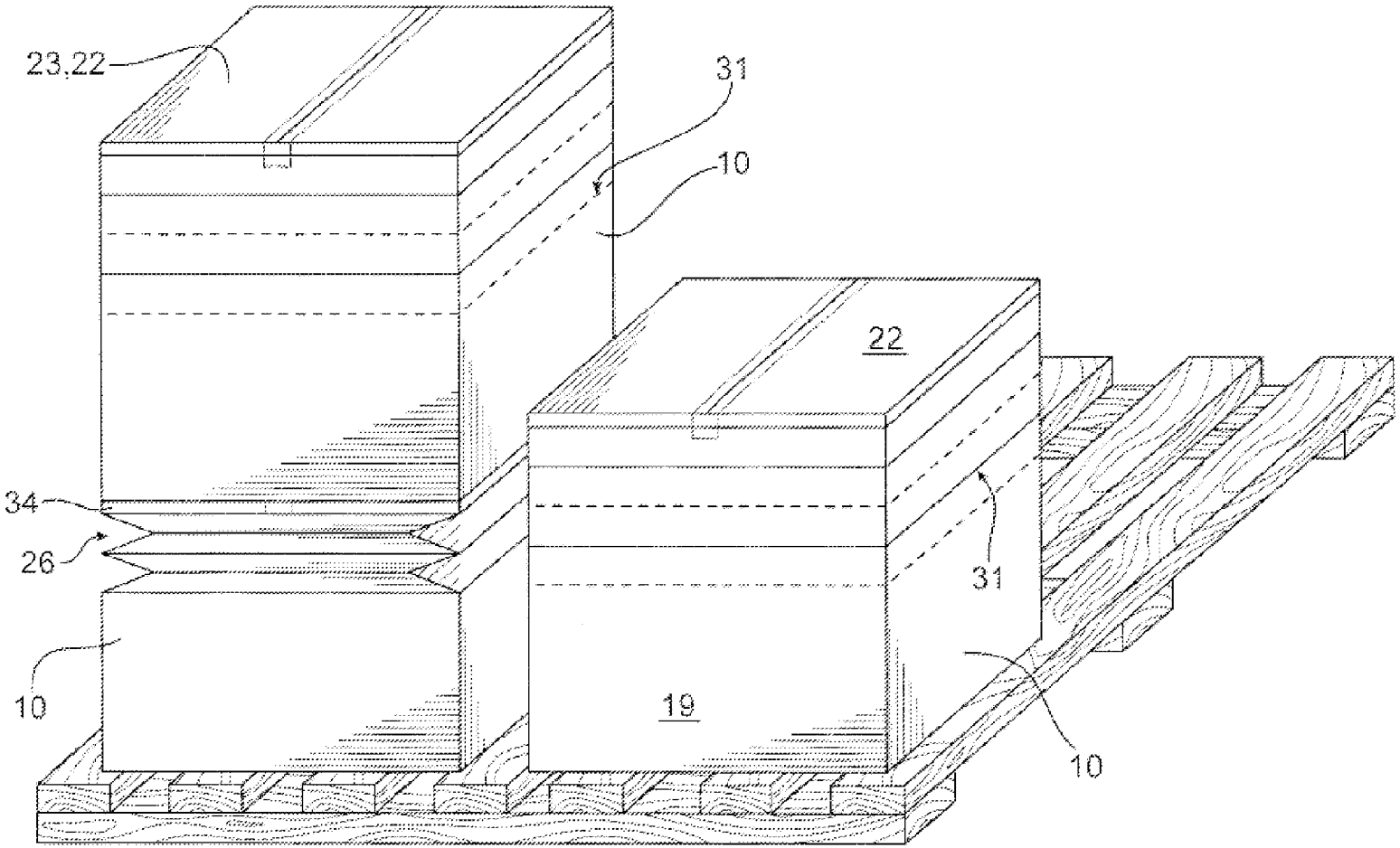
FIG. 4 is a perspective view of multiple cartons stacked together on a pallet in which one of the boxes is in a collapsed position.
Figure 6:
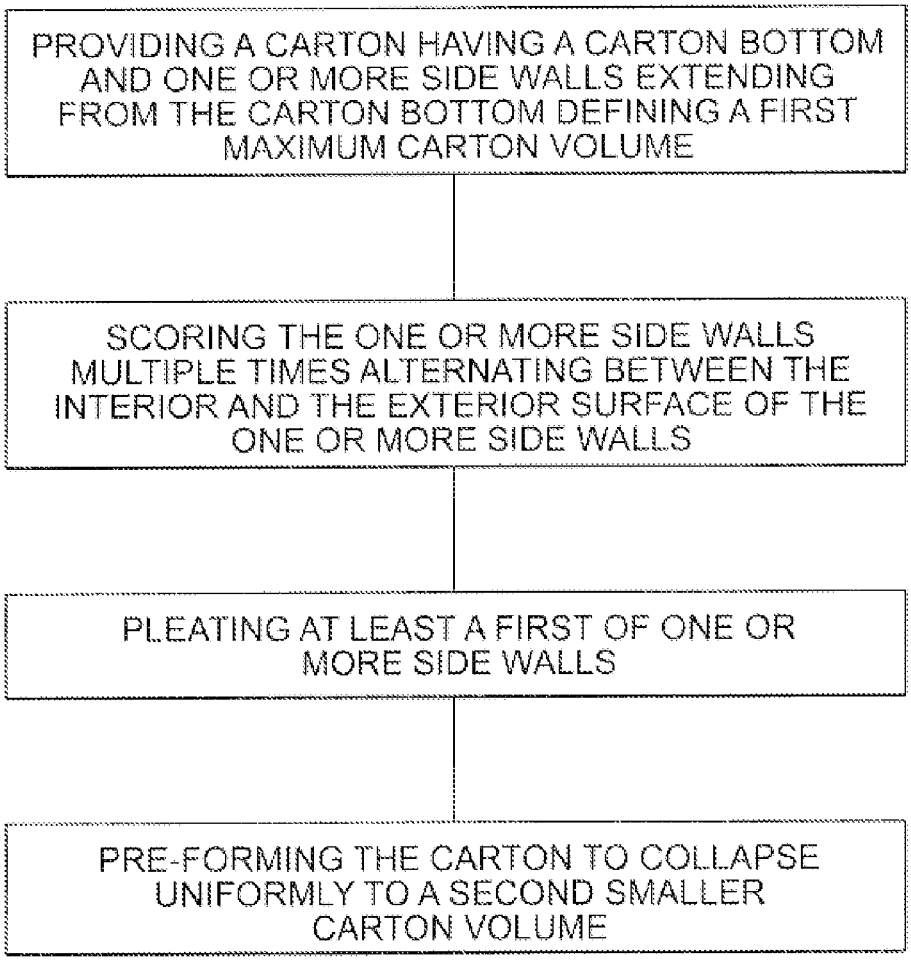
FIG. 6 is a block diagram of a method for constructing a collapsible carton.

With continued reference to the above discussed Figures and in particular FIG. 4 and FIG. 6, assembly and use of collapsible cartons 10 will now be described. In another embodiment, carton 10 is constructed from a generally planar and contiguous piece of material, cut to the appropriate configuration for assembling carton 10, which includes carton bottom 16, side walls 19 and lid panels 23, including major and minor lid panels. It is to be construed that any size or shape of carton 10 may be constructed without departing from the intended scope of coverage of the embodiments of the subject invention. In one embodiment, the side walls 19 and the minor lid panels are scored in a manner consistent with that described above for fashioning one or more pleats 26. After scoring, carton 10 may then be creased, folded and glued, or otherwise fastened, together thereby creating a box-like structure, i.e. carton 10. Tools or dies may then be utilized to pre-form the carton so that it collapses in a predetermined manner respective of the product stored therein. By pre-forming it is meant that the tools or dies bend the carton walls forcing the pleats inward or outward respective of the applied scores 31. For example, carton 10 may be pre-filled with a certain amount of product, i.e. articles 13, or the determination may be made to fill the carton with only a certain amount of product. The amount of extra space within carton 10 will be evident to the user or operator. Tooling is then chosen to bend only those scored regions of the walls 19 or lid 22 that the operator intends to collapse should sufficient force be applied to the top surface of carton 10. In this manner, carton 10 collapses from a first maximum volume to a second smaller by a pre-determined amount. Pre-forming ensures that all of the scored surfaces, that the operator intends, will collapsed to together in a uniform manner. However, even if the pleats 26 are not pre-formed, the scores 31 fashioned in the carton walls will cause carton 10 to automatically collapse in a pre-determined manner. The amount of reduced volume, of course will be determined by the size of the pleats 26 and the number of pleats 26 pre-formed to automatically bend when pressure is applied. In other words, the formation of pleats 26 in the carton walls allows the carton to automatically collapse in volumetric increments. After pre-forming, carton 10 may then be filled with product and sealed for shipment to the end-user. It will be recognized that pleating, or scoring, and pre-forming the minor lid panels will prevent the lid 22 from unexpectedly popping open during transit.

Figure 7:
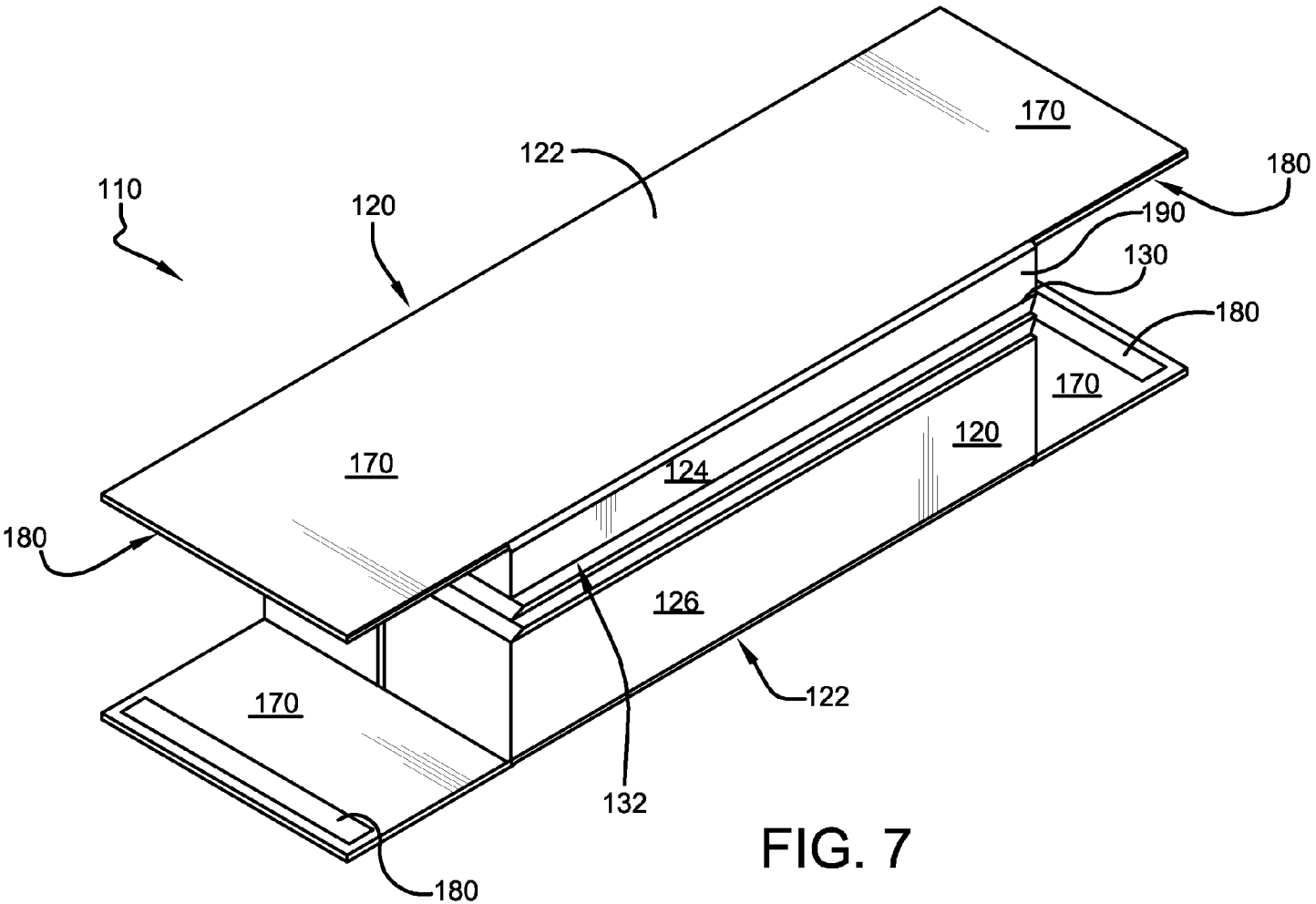
FIG. 7 is a perspective view of a side loadable carton having pleats with one pair of flaps closed and a second pair of flaps in the open position.

With reference to FIG. 7, a side-opening carton 110 is illustrated. In this embodiment, carton 110 includes a first pair of essentially vertical and parallel carton walls 120 spaced apart by a second pair of carton walls 122 defining a volume therebetween. Each of the first pair of carton walls 120 includes at least a first score 130 for facilitating the collapsing of carton 110 in a substantially uniform manner. The embodiment shown in FIG. 7 includes a plurality of scores 132 extending longitudinally along the length of carton walls 120. The plurality of scores 132 are substantially parallel with respect to one another and each of the second pair of carton walls 122, which define an upper panel 124 and lower panel 126.

Figure 9:
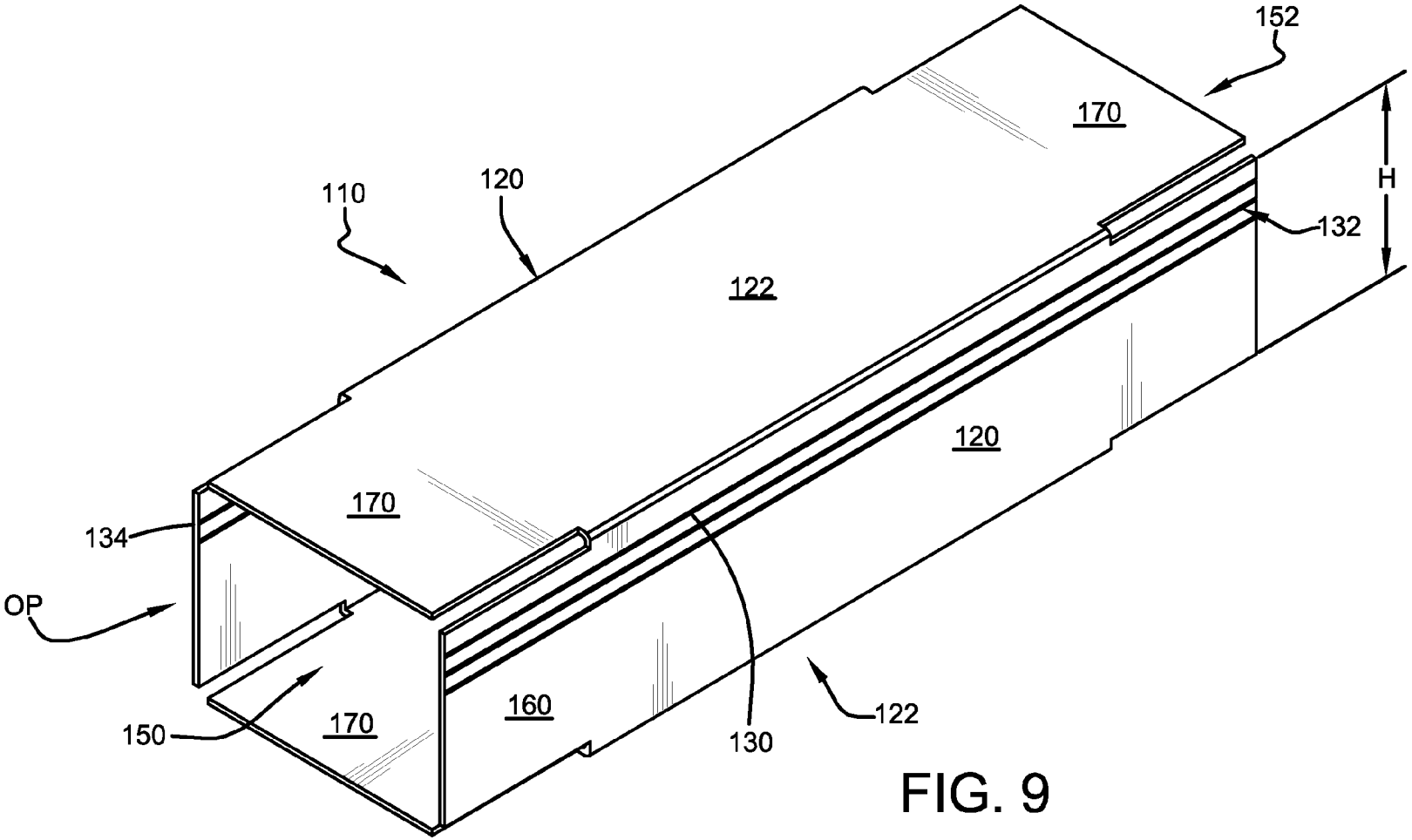
FIG. 9 is a perspective view of a carton having scores on at least opposed sides of the carton.
Figure 10:
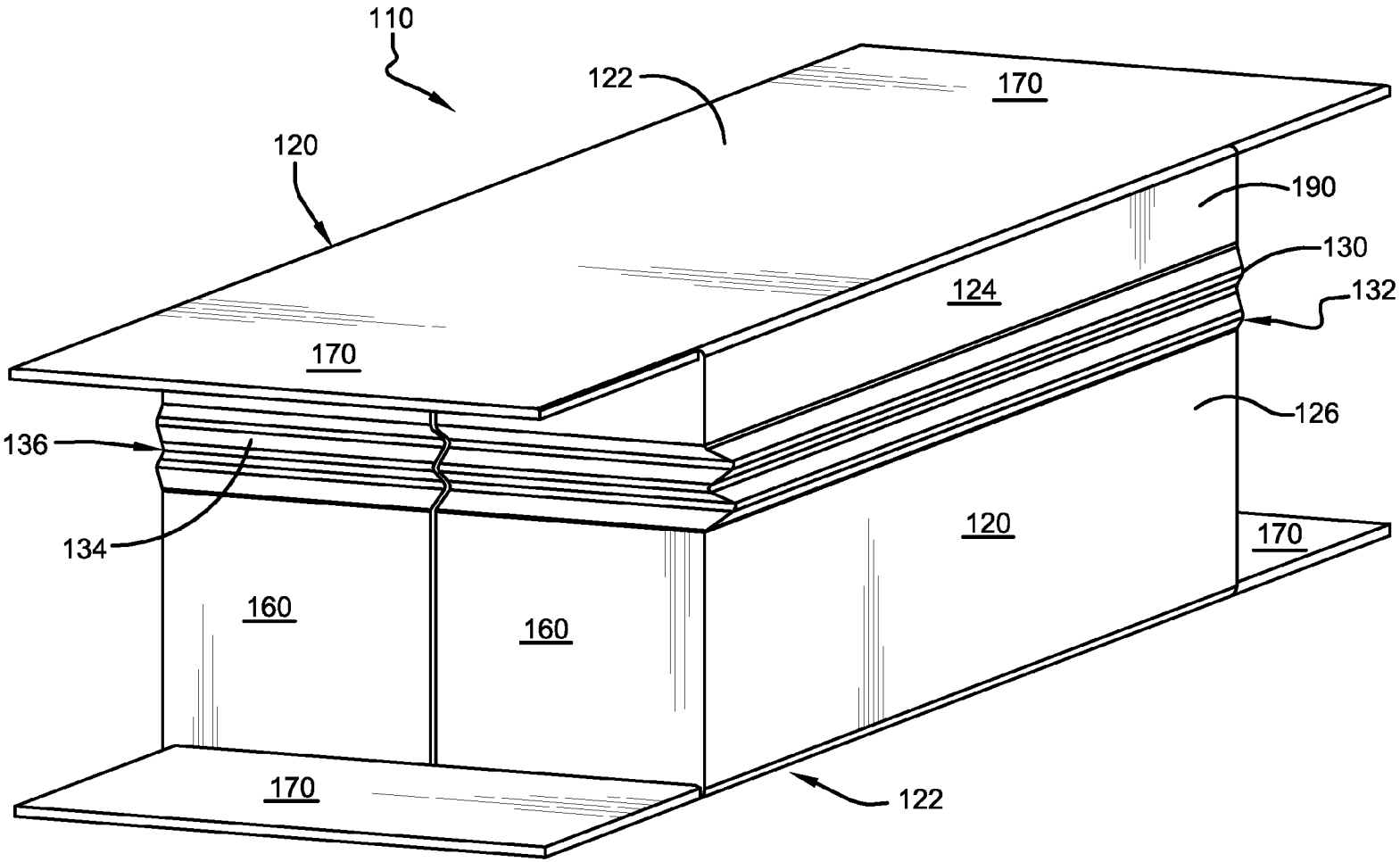
FIG. 10 is a second perspective view of a carton having pleats with one set of flaps in a closed position and another set of opposed flaps in an open position.

With reference to FIG. 9, carton 110 further includes at least a first opening 150 configured to receive articles (e.g., stick electrodes) therein. First opening 150 may be positioned at either end of carton 110, such that carton 110 is end loaded. Additionally, there may be a second opening 152 opposite first opening 150 of carton 110. Carton 110 optionally includes at least one minor flap 160 extending from one of the first pair of carton walls 120 or second pair of carton walls 122. In the embodiment shown in FIGS. 7 and 9, carton 110 includes a pair of minor flaps 160 each flap extending from one of the first pair of carton walls 120. Minor flaps 160 preferably include at least a first score 130 which is an extension of first score 130 on the first pair of carton walls 120. Minor flaps 160 shown in FIGS. 7 and 9 include a plurality of scores 132 extending along minor flaps 160 such that the plurality of scores 132 collapse in a substantially uniform manner relative to the plurality of scores 132 of the first pair of carton walls 120. In an embodiment where there are two openings formed at opposite ends of carton 110, both ends preferably include minor flaps 160 having scores similarly situated with respect to one another such that minor flaps 160 on each opposed end collapse in a substantially uniform manner. In an embodiment where first opening 150 is the sole opening of carton 110, the end of carton 110 opposite the first opening 150 may include a backside panel (not shown). The backside panel may also include a first score or a plurality of scores similarly situated to the score or plurality of scores on the opposite end of carton 110 to facilitate the collapsing of carton 110 in a substantially uniform manner.

Figure 8:
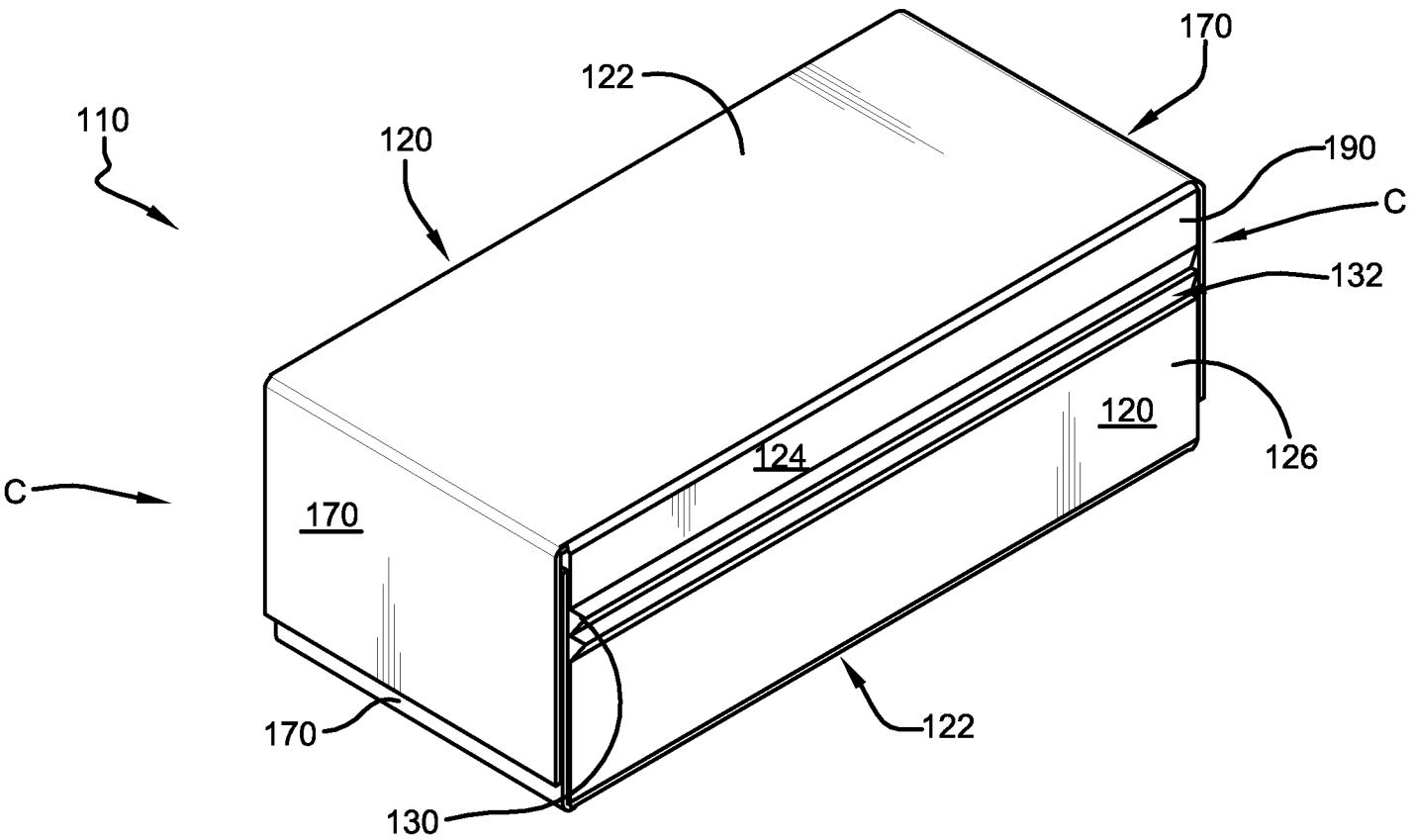
FIG. 8 is a perspective view of a carton in a closed and compressed position.
Figure 13:
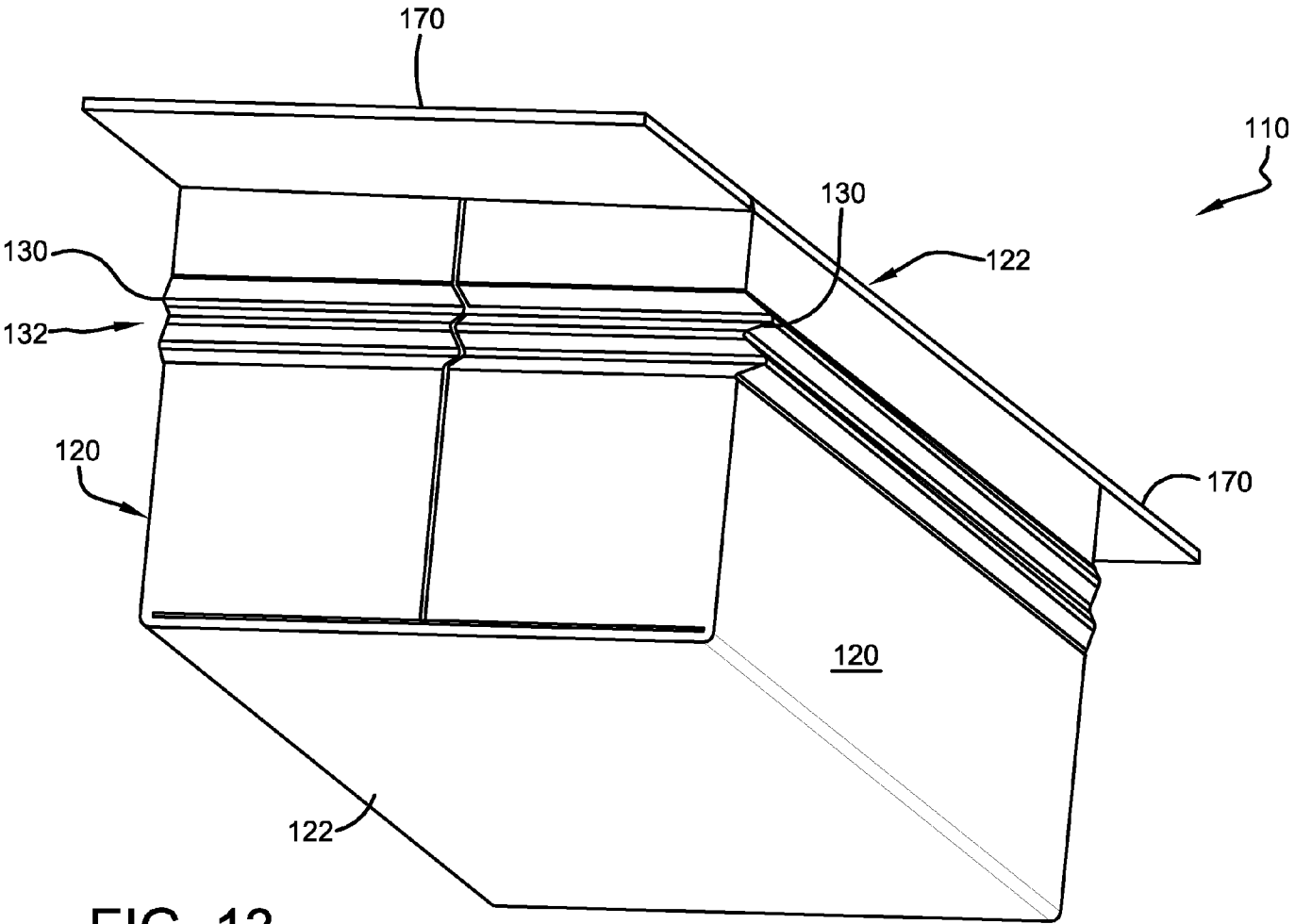
FIG. 13 is a perspective view of a carton having pleats and no bottom flaps.

With reference to FIGS. 8 and 13, carton 110 may further include at least one major flap 170 for maintaining carton 110 in closed position C. In the embodiment shown in FIG. 8, carton 110 includes a pair of major flaps 170 for maintaining carton 110 in closed position C. Each flap of the pair of major flaps 170 optionally, but preferably includes securing means 180 for securing the carton in closed position C. Securing means 180, better illustrated in FIG. 7, may be an adhesive removably secured to a surface of at least one of major flaps 170 for securing at least one of the major flaps 170 to at least a portion of carton 110 (e.g., securing to another major flap 170, or the one or more minor flaps 160) corresponding to the opening of carton 110. The adhesive may be a permanent adhesive or a pressure sensitive adhesive, and optionally having a release liner affixed thereto for removal prior to the step of affixation. Other means known to persons of ordinary skill in the arty may be used for maintaining carton 110 in closed position C via major flap 170, or in the alternative at least one, preferably both minor flaps 160. For example, ropes made from poly or cloth materials, belt-like structures, poly or steel strapping, banding, stapling, or any combination thereof may be employed to selectively secure carton 110 in closed position C. In another embodiment, a cap (not shown) may also be used alone or with the above examples to selectively secure carton 110 in closed position C. The cap may be sized such that it frictionally engages carton 110, thereby maintaining carton 110 in closed position C. Additionally, at least a portion of the cap may extend at least partially over the surface of the carton walls for maintaining carton 110 in closed position C.

With continued reference to FIG. 8, each of the pair of major flaps 170 extends outwardly from the second pair of carton walls 122 when carton 110, is in open position OP (FIG. 9). The length and width of each flap of major flaps 170 may be similar to or differ from each other. Moreover, the width of major flaps 170 may differ from the width of carton walls 122 from which it extends. Additionally, the length of major flaps 170 may be a length such that only a portion of first opening 150 or second opening 152, if carton 110 has an additional opening, is covered by a single major flap 170. However, alternatively, in a further embodiment, the length of major flap 170 may extend to cover the entire opening of carton 110, when carton 110 is in a collapsed position. In the embodiment shown, the width of each flap of major flaps 170 is substantially similar to the width of the respective second pair of carton walls 122. In this embodiment, the length of major flaps 170 are such that each flap of major flaps 170 do not individually extend over the entire opening, but instead the opening of carton 110 is substantially covered in a closed position C when major flaps 170 overlap each other.

With continued reference to FIGS. 8 through 13, carton 110 may further includes ledge 190 extending along the perimeter of carton 110. In the embodiment shown, ledge 190 is un-scored, and positioned adjacent to upper panel 124 of carton 110 on the side walls. In certain configurations, however, ledge 190 may be positioned on the carton side walls adjacent to lower panel 126. In extending along the perimeter of carton 110, ledge 190 may be contiguously formed upon the first pair of carton walls 120 and minor flaps 160 of carton 110. Ledge 190 formed on minor flaps 160 may further have a height substantially similar to ledge 190 formed on the first pair of carton walls 120.

Figure 11:
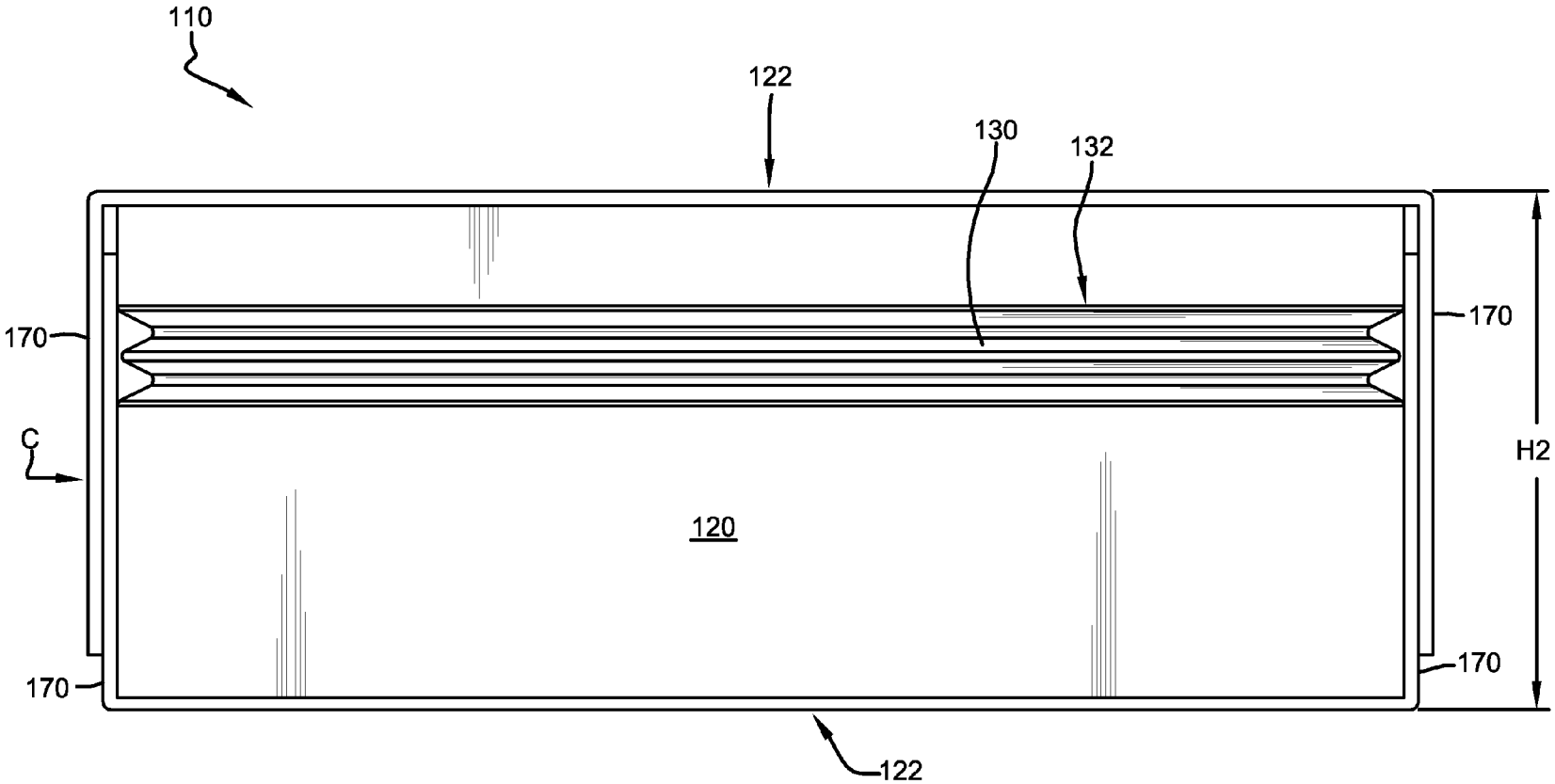
FIG. 11 is a side elevational view of a carton having pleats in the closed position.
Figure 12:
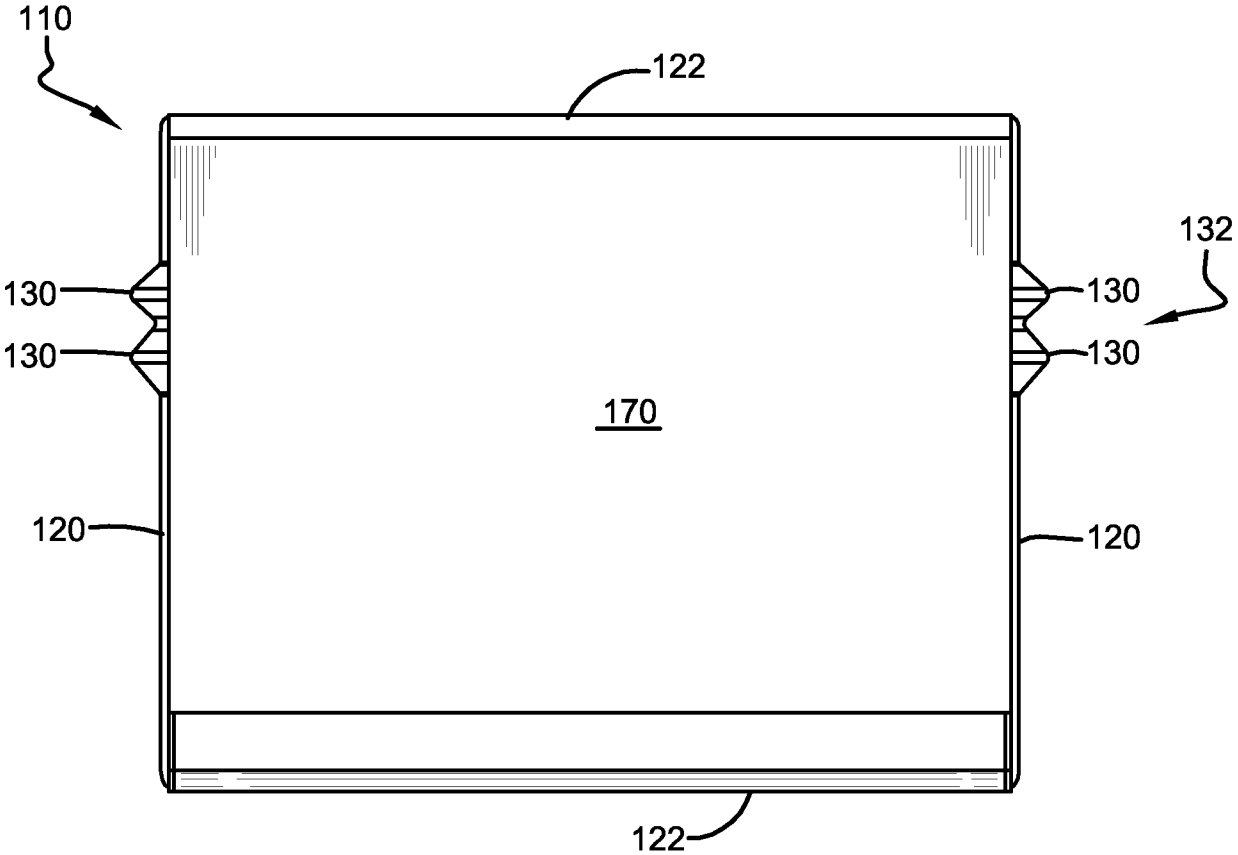
FIG. 12 is a second side elevation view of the carton of FIG. 11 rotated 90°.
Figure 14:
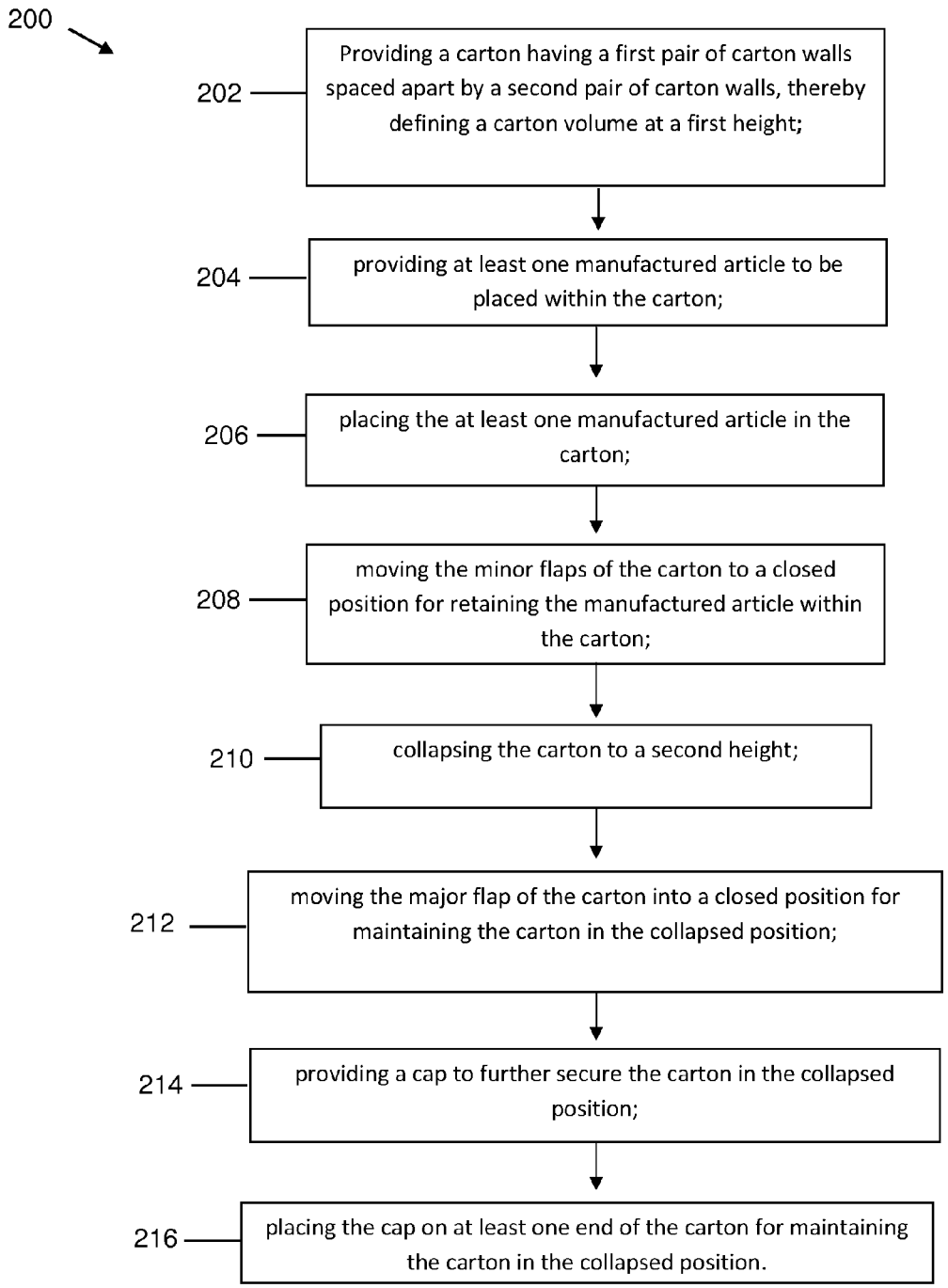
FIG. 14 is a block diagram of a method for constructing a collapsible carton.

FIG. 14 illustrates a flow chart of an embodiment of method 200 of collapsing a carton using the embodiments described herein. While the steps describe the use of the carton 110, it should be appreciated that the additional embodiments described herein may be used in a similar manner, and the steps described are not required to be performed in a particular sequence. In step 202, method 200 may include the step of providing carton 110 having a first pair of carton walls 120 spaced apart by a second pair of carton walls 122, thereby defining carton volume V at first height H (FIG. 9), wherein either the first pair of carton walls 120 or second pair of carton walls 122 includes at least a first score for collapsing carton 110 in a substantially uniform manner. In step 204, providing at least one manufactured article (e.g., stick electrode). In step 206, placing the at least one manufactured article in carton 110. In step 208, moving the minor flap(s) of carton 110 into a closed position for retaining the manufactured article within carton 110. The minor flap(s) include at least a first score corresponding to the at least a first score of the carton walls. In step 210, collapsing carton 110 (via pressure applied to at least one of the carton walls) to second height H2 (FIG. 11). In step 212, moving the major flap of carton 110 into a closed position for maintaining carton 110 in the collapsed position, wherein the major flap is secured to the carton using a securing means to prevent carton 110 from unintentionally opening from its closed position. In a further embodiment, step 214, includes providing a cap to further secure carton 110 in the collapsed position, however, a cap may also be use in lieu of major flaps, or in conjunction with any other securing means described herein. In step 216, placing the cap on at least one end of carton 110 for maintaining carton 110 in the collapsed position.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

We claim:

1. A collapsible carton comprising:

a first pair of vertical carton walls spaced apart by a second pair of carton walls extending substantially perpendicularly from the first pair of carton walls, thereby defining a first maximum carton volume between said first and second pair of carton walls, wherein the carton is fashioned to automatically collapse under pressure in a substantially uniform manner via at least a first score, thereby defining a second smaller carton volume, and wherein said first and second pair of carton walls form at least one side opening;

at least one carton closure formed from a pair of major flaps and a pair of minor flaps extending from and at least partially along the width of the carton, wherein the carton closure is substantially perpendicular to the carton walls in a closed position, thereby substantially covering the at least one side opening, and wherein at least one flap selected from the group consisting of the pair of major flaps and the pair of minor flaps includes a plurality of scores;

a second closure substantially covering a second side opening formed from the first and second pair of carton walls and opposite the at least one side opening;

the second closure is formed from a pair of minor flaps and a pair of major flaps; and at least one flap of the second closure selected from the group consisting of the pair of minor flaps and the pair of major flaps includes a plurality of scores; and a ledge disposed between the first pair of carton walls and the second pair of carton walls that have at least a vertical non-pleated portion, said ledge being continuous around a perimeter of the carton.

2. The collapsible carton as defined in claim 1, wherein the first pair of carton walls includes the least a first score extending at least partially along the width of the first pair of carton walls thereby facilitating the collapse of the carton in a substantially uniform manner.

3. The collapsible carton as defined in claim 2, wherein the first pair of carton walls include a plurality of scores respectively; and, wherein the plurality of scores are each substantially parallel with respect to each other.

4. The carton as defined in claim 3, wherein the plurality of scores on the carton closure are coplanar with the plurality of scores on the second pair of carton walls.

5. The collapsible carton as defined in claim 2, wherein the first pair of carton walls include a plurality of scores respectively; and, wherein the plurality of scores are alternately fashioned on inner and outer surfaces of the carton, thereby facilitating collapse of the carton in a pleated fashion.

6. The collapsible carton as defined in claim 1, wherein the carton respectively collapses substantially uniformly from a first height to a second shorter height.

7. The collapsible carton as set forth in claim 1, wherein the pair of minor flaps include the plurality of scores.

8. The carton as defined in claim 1, wherein at least one flap of the second closure selected from the group consisting of the pair of minor flaps and the pair of major flaps and further comprises a fastening means.

9. The carton as defined in claim 1 further comprising a means for securing the at least one carton closure in a closed position.

10. A carton comprising:

a plurality of carton walls defining a first maximum carton volume, wherein the carton is fashioned to automatically collapse via at least a first score under pressure in a substantially uniform manner defining a second smaller carton volume, wherein the plurality of carton walls form at least one first end opening, and wherein at least two of the plurality of carton walls include:

a non-pleated section that contains no scores, and a pleated section that includes a plurality of scores that are each substantially parallel with respect to each other, wherein the pleated section is disposed between the non-pleated section and a ledge and further wherein the ledge is continuous around a perimeter of the carton;

at least one carton closure formed from a plurality of panels extending from and along at least a portion of the width of each of the carton walls, wherein the plurality of panels are substantially perpendicular to the plurality of carton walls in a closed position for substantially covering the at least one end opening, and wherein at least one panel of the plurality of panels includes a plurality of scores;

a second carton closure substantially covering a second end opening, wherein the second carton closure includes a plurality of panels, and wherein the second end opening is opposite the first end opening;

a means for collapsing the second carton closure; and at least one of the plurality of panels of the second closure includes a means for securing the second carton closure in a closed position.

* * * * *